US012577834B2

(12) United States Patent
Narayanan et al.

(10) Patent No.: US 12,577,834 B2
(45) Date of Patent: Mar. 17, 2026

(54) HYDRAULIC ACTUATOR FOR CONTROLLING OPERATIONS OF DRILLING MACHINES

(71) Applicant: Caterpillar Inc., Peoria, IL (US)

(72) Inventors: Rameshkrishnan Lakshmi Narayanan, Chennai (IN); Vignesh S., Chennai (IN); Anand Jason Vedaraj, Chennai (IN); Kurt Steven Goslovich, Naperville, IL (US)

(73) Assignee: Caterpillar Inc., Peoria, IL (US)

( * ) Notice: Subject to any disclaimer, the term of this patent is extended or adjusted under 35 U.S.C. 154(b) by 27 days.

(21) Appl. No.: 18/652,086

(22) Filed: May 1, 2024

(65) Prior Publication Data

US 2024/0384600 A1 Nov. 21, 2024

(30) Foreign Application Priority Data

May 19, 2023 (AU) ..... 2023203152

(51) Int. Cl.
*E21B 7/02* (2006.01)
*E21B 19/084* (2006.01)

(52) U.S. Cl.
CPC ..... *E21B 7/022* (2013.01); *E21B 19/084* (2013.01)

(58) Field of Classification Search
CPC ..... E21B 7/022; E21B 19/084
See application file for complete search history.

(56) References Cited

U.S. PATENT DOCUMENTS

| | | | |
|---|---|---|---|
| 4,759,738 | A | 7/1988 | Johnson |
| 5,267,621 | A | 12/1993 | Deken et al. |
| 10,006,262 | B2 | 6/2018 | Bansal et al. |
| 10,273,753 | B2 | 4/2019 | Marland et al. |
| 10,544,631 | B2 | 1/2020 | Reinecke |
| 11,225,840 | B2 | 1/2022 | Gunsaulis |
| 2019/0218902 | A1* | 7/2019 | Demick ..... E21B 19/084 |

FOREIGN PATENT DOCUMENTS

CN 113494241 A 10/2021

* cited by examiner

*Primary Examiner* — Michelle Lopez

(57) ABSTRACT

A hydraulic actuator, for controlling an operation of a drilling machine, includes a rod assembly and a tube assembly. The tube assembly defines a bore to receive the rod assembly therethrough and is moveable with respect to the rod assembly upon an influx and an efflux of a pressurized fluid with respect to the bore to control a feed of a drill head assembly of the drilling machine. The rod assembly is formed from a plurality of parts separable from one another to facilitate assembly or disassembly of the rod assembly with respect to the tube assembly.

20 Claims, 9 Drawing Sheets

HYDRAULIC ACTUATOR FOR CONTROLLING OPERATIONS OF DRILLING MACHINES

CROSS-REFERENCE TO RELATED APPLICATION

This application claims priority under 35 USC § 119 and the Paris Convention to Australian Patent Application 2023203152 filed on May 19, 2023.

TECHNICAL FIELD

The present disclosure relates to drilling machines. More particularly, the present disclosure relates to a hydraulic actuator for controlling a feed of a drill head assembly of a drilling machine.

BACKGROUND

Drilling machines are used to drill into ground surfaces in applications, such as mining. A drilling machine typically includes a drill string assembly and a hydraulic actuator. The drill string assembly may be formed as a combination of a drill head assembly, drill pipes, and a drill bit, that moves along a mast frame of the drilling machine to drill bores into the ground surface. The hydraulic actuator typically includes a tube assembly and a rod assembly received within the tube assembly. The tube assembly and rod assembly may be displaceable with respect to one another to facilitate the movement of the drill string assembly along the mast frame. As these tube assembly and rod assembly have large, monolithic constructions, they are difficult to transport, handle, assemble/disassemble, and service.

SUMMARY OF THE INVENTION

In one aspect, the disclosure relates to a hydraulic actuator for controlling an operation of a drilling machine. The hydraulic actuator includes a tube assembly and a rod assembly. The tube assembly defines a bore to receive the rod assembly therethrough and is moveable with respect to the rod assembly upon an influx and an efflux of a pressurized fluid with respect to the bore to control a feed of a drill head assembly of the drilling machine. The rod assembly is formed from a plurality of parts separable from one another to facilitate assembly or disassembly of the rod assembly with respect to the tube assembly.

In another aspect, the disclosure is directed to a drilling machine. The drilling machine includes a mast frame, a drill string assembly, and a hydraulic actuator. The drill string assembly is configured to perform an operation of the drilling machine. The drill string assembly includes a drill head assembly and one or more pipe segments coupled to the drill head assembly. The hydraulic actuator controls the operation of the drilling machine. The hydraulic actuator includes a tube assembly and a rod assembly. The tube assembly defines a bore to receive the rod assembly therethrough and is moveable with respect to the rod assembly upon an influx and an efflux of a pressurized fluid with respect to the bore to control a feed of the drill head assembly. The rod assembly is formed from a plurality of parts separable from one another to facilitate assembly or disassembly of the rod assembly with respect to the tube assembly.

DETAILED DESCRIPTION

Reference will now be made in detail to specific embodiments or features, examples of which are illustrated in the accompanying drawings. Generally, corresponding reference numbers may be used throughout the drawings to refer to the same or corresponding parts, e.g., 1, 1', 1", 101 and 201 could refer to one or more comparable components used in the same and/or different depicted embodiments.

The term "about" used in conjunction with a numerical value or range modifies that value or range by extending the boundaries above and below the numerical values set forth. In general, the term "about" is used herein to modify a numerical value above and below the stated value by 10%.

Figure 1:
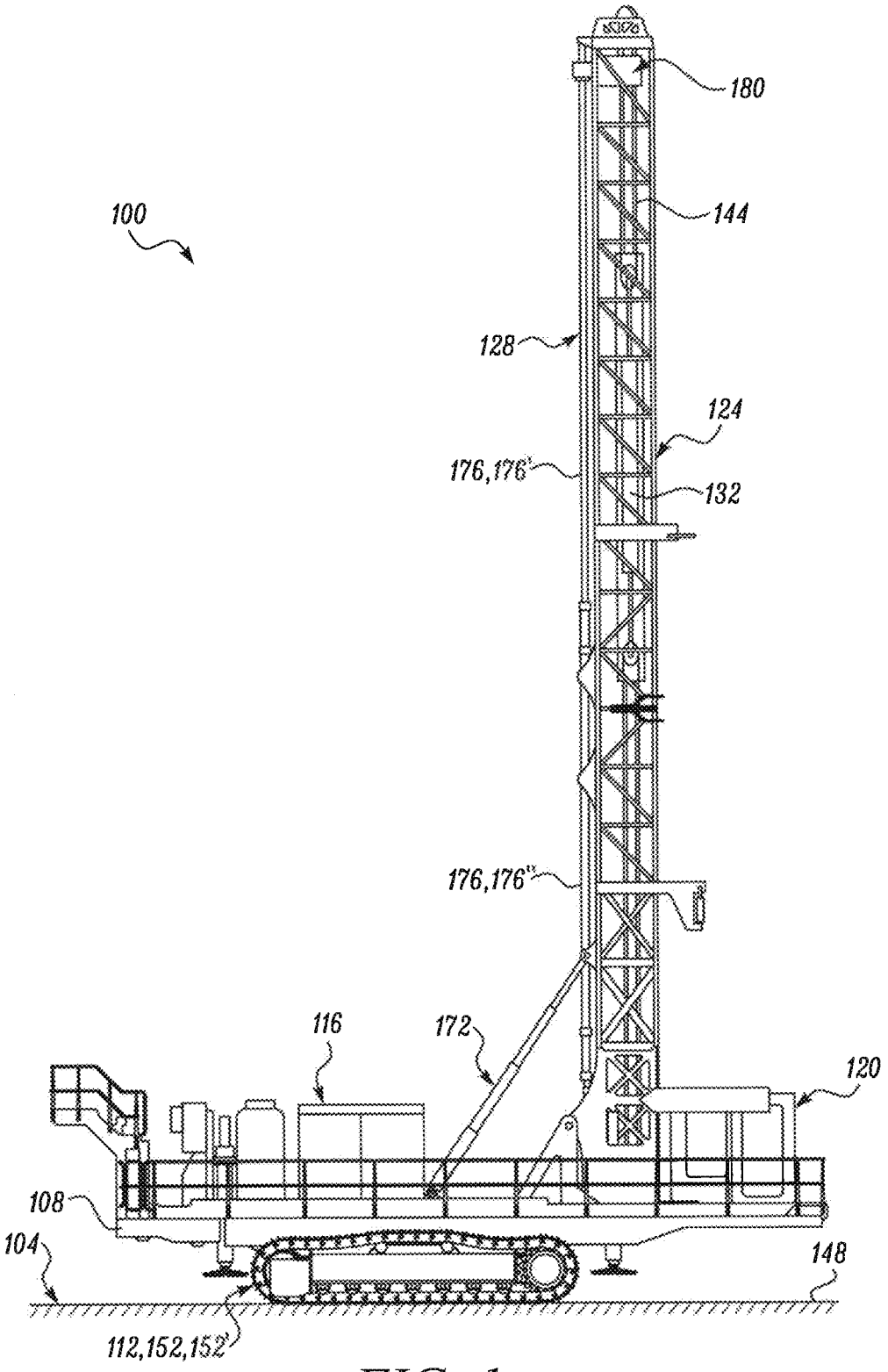
FIG. 1 is a side view of an exemplary drilling machine having mast frame, a hydraulic actuator, and a drill string assembly supported on the mast frame, in accordance with an embodiment of the present disclosure.

Referring to FIG. 1, an exemplary drilling machine 100 is shown. The drilling machine 100 may be employed to perform one or more operations, namely—a tramming operation, in which the drilling machine 100 moves from one location to another location at a jobsite 104; and a drilling operation, in which the drilling machine 100 penetrates the earth to mine for materials, such as ore, soil, debris, or other naturally occurring deposits at the jobsite 104.

The drilling machine 100 may include a chassis 108, ground-engaging traction assemblies 112, a power system 116, and an operator cabin 120. Also, the drilling machine 100 includes a mast frame 124, a drill string assembly 128, a hydraulic actuator 132, a first retainer 136, a second retainer 140, and a sheave assembly 144.

The chassis 108 may support the power system 116, the operator cabin 120, and the mast frame 124, although other known components and structures may be supported by the chassis 108, as well. The ground-engaging traction assemblies 112 may support the chassis 108 on the ground 148 at the jobsite 104. The ground-engaging traction assemblies 112 may include a set of crawler tracks 152. The crawler tracks 152 may be configured to move and transport the drilling machine 100 from one location to another at the jobsite 104, according to a customary practice known in the art. In the present embodiment, two crawler tracks 152 are provided, one on each side of the drilling machine 100 (only one crawler track 152' is visible in FIG. 1). In some embodiments, the ground-engaging traction assemblies 112 may include wheeled units (not shown) provided either alone or in combination with the crawler tracks 152.

The power system 116 may include a power compartment 156 and a power source (not shown) provided within the power compartment 156. The power source may include a combustion engine, or an electrical power source, or a combination thereof. The power source may be configured to generate an output power required to operate various systems or assemblies on the drilling machine 100, with one operation exemplarily involving actuation of the hydraulic actuator 132 to correspondingly move the drill string assembly 128 relative to the mast frame 124.

The operator cabin 120 may be supported over the chassis 108. The operator cabin 120 may facilitate stationing of one or more operators therein, to monitor the operations of the drilling machine 100. Also, the operator cabin 120 may house various components and controls of the drilling machine 100, such as joysticks, display units, etc. (not shown), that may be used for facilitating the machine's movement and operation at the jobsite 104. In some embodiments, the drilling machine 100 may be operated autonomously or semi-autonomously. In such a case, the operator cabin 120 may be located remotely from the drilling machine 100.

Figure 2:
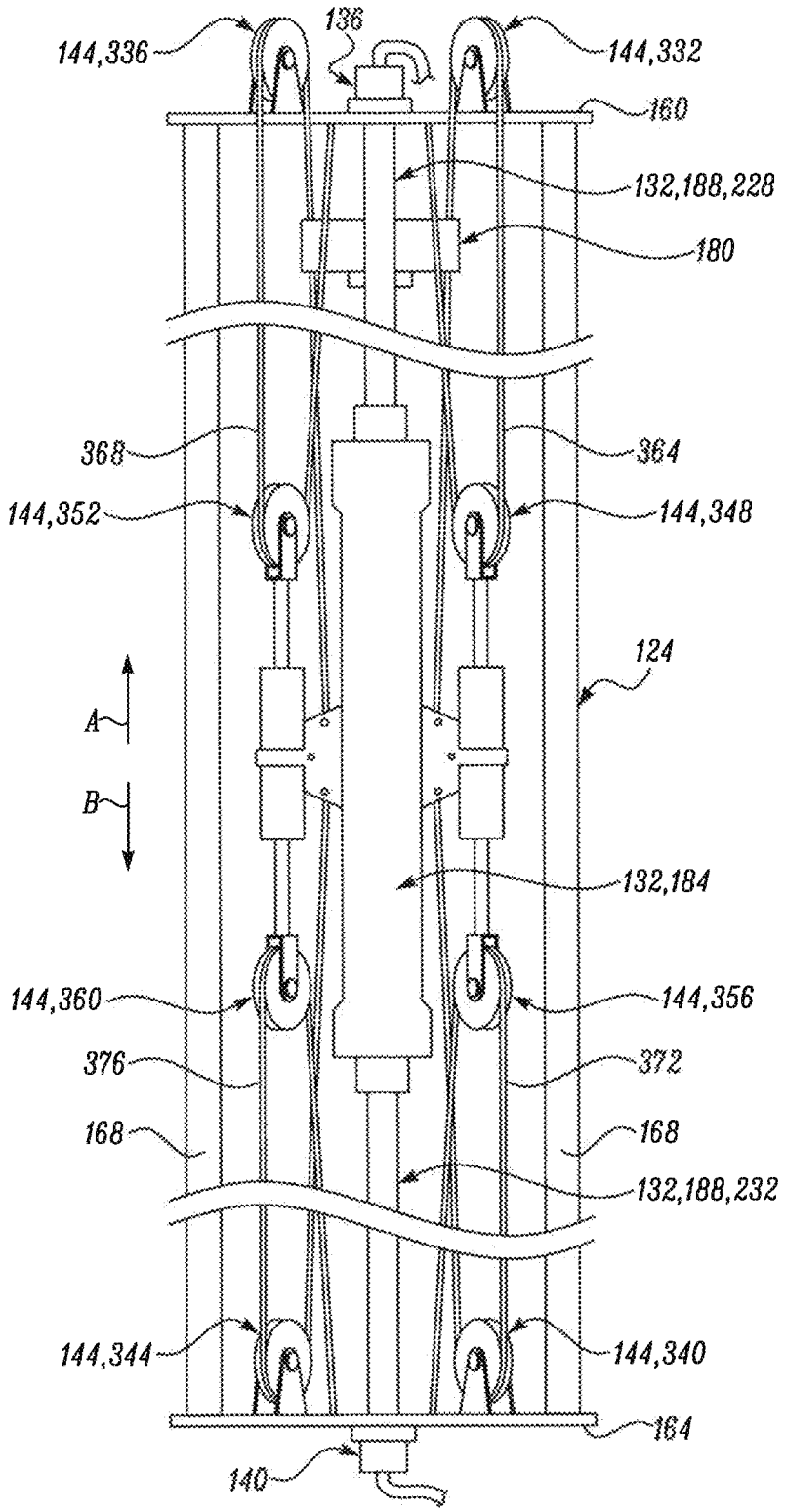
FIG. 2 illustrates a schematic view of the mast frame supporting the drill string assembly and the hydraulic actuator, in accordance with an embodiment of the present disclosure.

The mast frame 124 may include a first end frame 160, a second end frame 164, and beams 168 (as shown in FIG. 2). The first end frame 160 and the second end frame 164 are offset from one another along a length of the mast frame 124. The beams 168 may extend between the first end frame 160 and the second end frame 164 along the length of the mast frame 124. It may be noted that the mast frame 124 may also include various links and reinforcements, however, such links and reinforcements are not discussed, as they may be contemplated by someone of skill in the art.

The mast frame 124 may be coupled and mounted to the chassis 108. As an example, the mast frame 124 may be pivotably coupled to the chassis 108 to move between a first position and a second position with respect to the chassis 108. For example, the first position of the mast frame 124 may be a position at which the drilling machine 100 may perform drilling and, the second position of the mast frame 124 may be a position at which the mast frame may be stowed on the drilling machine 100, and in which position, the drilling machine 100 may tram across the jobsite 104. The configuration of the mast frame 124 in FIG. 1 illustrates the first position of the mast frame 124. In the present embodiment, the mast frame 124 may move between the first position and the second position by way of one or more mast position actuator 172 (see FIG. 1). The mast position actuator 172 may be selected from at least one of hydraulically powered mast position actuators, pneumatically powered mast position actuators, and the likes.

The drill string assembly 128 is configured to perform an operation, e.g., the drilling operation, of the drilling machine 100. The drill string assembly 128 includes one or more pipe segments 176, a drill bit (not shown), and a drill head assembly 180. Each of the pipe segments 176 may have a hollow and generally cylindrical configuration. The pipe segments 176 are coupled end-to-end with each other. For example, a pipe segment 176' is coupled to a pipe segment 176" by way of a threaded connection (not shown). In other embodiments, the pipe segments 176 may be coupled to each other by way of other known connections, for example, by lock fittings, snap fittings, and so on, based on application requirements.

The drill bit may be coupled to at least one of the pipe segments 176. In an example, in which the mast frame 124 is at the first position (as shown in FIG. 1), the drill bit is coupled to a bottom end (not shown) of the bottommost pipe segment, e.g., the pipe segment 176". In the present embodiment, the drill bit may be a down-the-hole (DTH) hammer-type drill bit. In other embodiments, the drill bit may embody any suitable type of drill bit such as a tri-cone drill bit, a polycrystalline diamond compact (PDC) drill bit, and the likes.

The drill head assembly 180 may be coupled to the pipe segments 176. In the exemplary embodiment, as shown in FIG. 1, the drill head assembly 180 is coupled to the pipe segment 176'. The drill head assembly 180 is configured to rotate the pipe segments 176 and the drill bit. The drill head assembly 180 may be powered by the power system 116 to rotate the pipe segments 176 and the drill bit. In the present embodiment, the drill head assembly 180 is a hydraulic drill head assembly. In other embodiments, the drill head assembly 180 may be a pneumatic drill head assembly, or an electro-hydraulic drill head assembly, or the like.

Further, the drill head assembly 180 (coupled to the pipe segments 176 and the drill bit) may be movably mounted on the mast frame 124. Accordingly, the drill head assembly 180 may facilitate movement of the drill string assembly 128 along the mast frame 124 to perform the drilling operation. In an exemplary drilling operation in which the mast frame is at the raised position (see FIG. 1), the drill head assembly 180 is moved upward and downward (i.e., feed) along the mast frame 124 (between the first end frame 160 and the second end frame 164) to move the drill bit relative to the ground 148 to drill a hole of a desired size and depth.

To control the upward and downward movement (i.e., feed) of the drill head assembly 180 along the mast frame 124, in one or more aspects of the present disclosure, the hydraulic actuator 132 is provided. The hydraulic actuator 132 includes a tube assembly 184 and a rod assembly 188. Each of the tube assembly 184 and the rod assembly 188 will be discussed in detail below.

Figure 3:
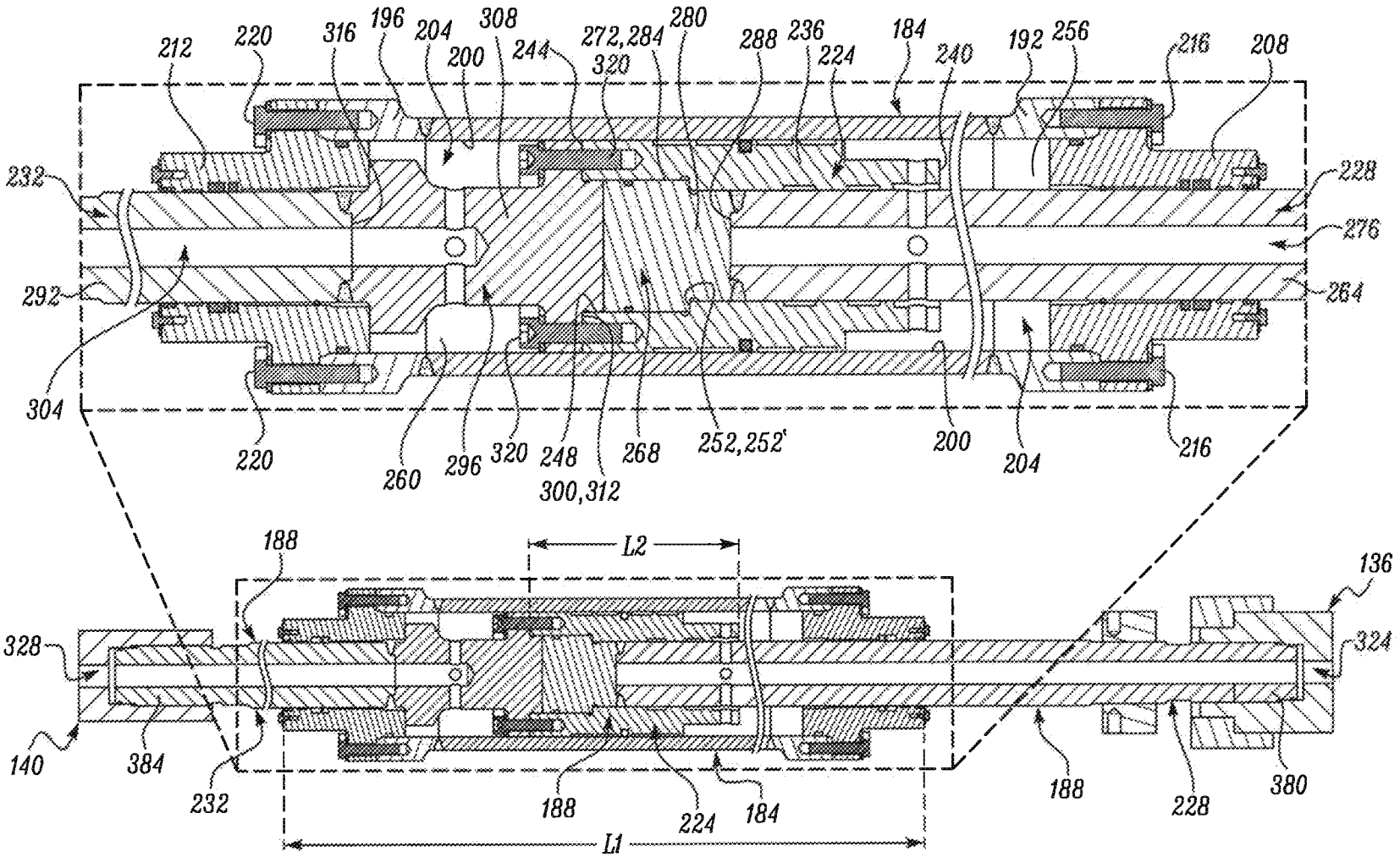
FIG. 3 illustrates the hydraulic actuator, in accordance with an embodiment of the present disclosure.

Referring to FIGS. 2 and 3, the tube assembly 184 defines a first end portion (flange) 192 and a second end portion (flange) 196 offset from the first end portion along a length 'L1' of the tube assembly 184. Also, the tube assembly 184 defines an inner surface 200 extending between the first end portion (flange) 192 and the second end portion (flange) 196 and a bore 204 surrounded by the inner surface 200. The bore 204 is configured to receive the rod assembly 188 therethrough. Further, the hydraulic actuator 132 may include a first end structure (head/gland) 208 and a second end structure (head/gland) 212. The first end structure (head/gland) 208 may be coupled to the first end portion (flange) 192 of the tube assembly 184 and, the second end structure 212 may be coupled to the second end portion 196 of the tube assembly 184. In an exemplary embodiment, as shown in FIG. 3, the first end structure 208 is coupled to the first end portion 192 via bolts 216 and, the second end structure 212 is coupled to the second end portion 196 via bolts 220.

The rod assembly 188 is now discussed. The rod assembly 188 has a polylithic construction. For instance, the rod assembly 188 is formed from a plurality of parts, namely a piston 224, a first rod 228, and a second rod 232. The parts (i.e., the piston 224, the first rod 228, and the second rod 232) are separable from one another to facilitate easy and quick assembly or disassembly of the rod assembly 188 with respect to the tube assembly 184. Each of the piston 224, the first rod 228, and the second rod 232 will be discussed in detail below.

The piston 224 includes a body 236. The body 236 may define a first end surface 240, a second end surface 244, and a through-bore 248. The first end surface 240 and the second end surface 244 may be longitudinally offset from each other along a length 'L2' of the body 236. The second end surface 244 may facilitate coupling of the piston 224 with the second rod 232. The through-bore 248 may extend between the first end surface 240 and the second end surface 244. The through-bore 248 may define an inner engagement surface 252. In an exemplary embodiment, as shown in FIG. 3, the inner engagement surface 252 includes a stepped portion 252. The through-bore 248 with the inner engagement surface 252 (or the stepped portion 252) facilitates coupling of the piston 224 with the first rod 228. In an exemplary assembly of the rod assembly 188 with the tube assembly 184, the piston 224 may be arranged within the bore 204 (of the tube assembly 184) to define a first fluid chamber 256 and a second fluid chamber 260 with the bore 204.

The first rod 228 may include a hollow longitudinal body 264, a first stopper 268, and an outer mating surface 272. It should be noted that the term "hollow longitudinal body" may refer to a body having one or more walls surrounding an interior cavity or channel. For example, the letter "O" resembles a hollow body that defines a circular wall surrounding an interior cavity or channel. In the present embodiment, as shown in FIG. 3, the hollow longitudinal body 264 (of the first rod 228) defines a first channel 276. The first channel 276 may extend along and throughout a length of the first rod 228. The first channel 276 is configured to be in fluid communication with the first fluid chamber 256 to facilitate an influx and an efflux of a pressurized fluid into and from the first fluid chamber 256.

The first stopper 268 may define a stopper body 280 and a protrusion 284 extending outwardly and away from the stopper body 280. The first stopper 268 may be coupled to the hollow longitudinal body 264. For example, as shown in FIG. 3, the first stopper 268 is welded to an end 288 of the hollow longitudinal body 264. The outer mating surface 272 may be defined by the protrusion 284. The outer mating surface 272 (e.g., the protrusion 284) may be configured to be engaged with (or seated against) the inner engagement surface 252 (e.g., the stepped portion 252') of the piston 224 to lock the first rod 228 with respect to the piston 224.

The second rod 232 may include a hollow longitudinal body 292, a second stopper 296, and a mounting surface 300. In the present embodiment, as shown in FIG. 3, the hollow longitudinal body 292 defines a second channel 304. The second channel 304 may extend along and throughout a length of the second rod 232. The second channel 304 is configured to be in fluid communication with the second fluid chamber 260 to facilitate the influx and the efflux of the pressurized fluid into and from the second fluid chamber 260.

The second stopper 296 may define a stopper body 308 and a projection 312 extending outwardly and away from the stopper body 308. The second stopper 296 may be coupled to the hollow longitudinal body 292. For example, as shown in FIG. 3, the second stopper 296 is welded to an end 316 of the hollow longitudinal body 292. The mounting surface 300 may be defined by the projection 312. The mounting surface 300 (e.g., the projection 312) may be configured to be abutted and fastened to the second end surface 244 of the piston 224, for example, by using one or more bolts 320 (a bolted connection).

The piston 224 is coupled to the first rod 228 and the second rod 232 to form the rod assembly 188. In an exemplary assembly of the piston 224 with the first rod 228, as shown in FIG. 3, the first rod 228 is received at the second end surface 244 of the piston 224 and is moved towards the first end surface 240 (of the piston 224) to engage the outer mating surface 272 (e.g., the protrusion 284) of the first rod 228 with the inner engagement surface 252 (e.g., the stepped portion 252') of the piston 224. The engagement of the outer mating surface 272 (e.g., the protrusion 284) with the inner engagement surface 252 (e.g., the stepped portion 252) locks the first rod 228 with respect to the piston 224. It may be contemplated that the piston 224 and the first rod 228 may be disassembled by reversing the above-discussed steps involved in the assembly of the piston 224 and the first rod 228.

Further, in an exemplary assembly of the piston 224 with the second rod 232, the mounting surface 300 (e.g., the projection 312) of the second rod 232 is abutted against the second end surface 244 of the piston 224. Next, the mounting surface 300 (e.g., the projection 312) and the second end surface 244 are fastened together, for example, by using one or more bolts 320. Once assembled, the rod assembly 188 defines a length equal to or greater than 15 meters. In an example, the rod assembly 188 has a length of about 17 meters. In another example, the rod assembly 188 may have a length of about 20 meters. In yet another example, the rod assembly may have a length of about 25 meters. It may be contemplated that the piston 224 and the second rod 232 may be disassembled by reversing the above-discussed steps involved in the assembly of the piston 224 and the second rod 232.

In an exemplary assembly of the rod assembly 188 with the tube assembly 184, the rod assembly 188 (i.e., the piston 224, the first rod 228, and the second rod 232) is received and arranged within the bore 204 of the tube assembly 184 such that the tube assembly 184 and the rod assembly 188 are in slidable engagement (e.g., a linearly slidable engagement) with respect to one another. Next, the first end structure 208 and the second end structure 212 are coupled to the first end portion 192 and the second end portion 196, respectively, using corresponding bolts 216, 220. It may be contemplated that the rod assembly 188 and the tube assembly 184 may be disassembled by reversing the above-discussed steps involved in the assembly of the rod assembly 188 and the tube assembly 184.

The first retainer 136 is now discussed. The first retainer 136 may be configured to fixedly couple the first rod 228 to the first end frame 160 of the mast frame 124. In the present embodiment, as shown in FIG. 3, the first retainer 136 may define a first passageway 324 extending throughout a length of the first retainer 136. The first passageway 324 may be configured to establish a fluid communication with the first channel 276 (of the first rod 228) and, hence with the first fluid chamber 256 to facilitate the influx and the efflux of the pressurized fluid into and from the first fluid chamber 256. In the present embodiment, the first retainer 136 is a hydraulically actuated nut assembly 136'. In other embodiments, the first retainer 136 may be any suitable fastening component known in the art.

The second retainer 140 is now discussed. The second retainer 140 may be configured to fixedly couple the second rod 232 to the second end frame 164 of the mast frame 124. In the present embodiment, as shown in FIG. 3, the second retainer 140 may define a second passageway 328 extending throughout a length of the second retainer 140. The second passageway 328 may be configured to establish a fluid communication with the second channel 304 (of the second rod 232) and, hence with the second fluid chamber 260 to facilitate the influx and the efflux of the pressurized fluid into and from the second fluid chamber 260. In the present embodiment, the second retainer 140 is a hydraulically actuated nut assembly 140'. In other embodiments, the second retainer 140 may be any suitable fastening component known in the art.

The sheave assembly 144 is now discussed. The sheave assembly 144 may be configured to operably couple the hydraulic actuator 132 with the drill string assembly 128. In the present embodiment, the sheave assembly 144 is coupled between the tube assembly 184 (of the hydraulic actuator 132) and the drill head assembly 180 (of the drill string assembly 128). For instance, as shown in FIG. 2, the sheave assembly 144 includes eight sheaves, namely, a first sheave 332, a second sheave 336, a third sheave 340, a fourth sheave 344, a fifth sheave 348, a sixth sheave 352, a seventh sheave 356, and an eighth sheave 360.

The first sheave 332 and the second sheave 336 are fixedly coupled to the first end frame 160 of the mast frame 124. The third sheave 340 and the fourth sheave 344 are fixedly coupled to the second end frame 164 of the mast frame 124. The fifth sheave 348, the sixth sheave 352, the seventh sheave 356, and the eighth sheave 360 are fixedly coupled to the tube assembly 184 of the hydraulic actuator 132. The first sheave 332 and the fifth sheave 348 are operably coupled to one another, via a first cable 364. The first cable 364 may be coupled at one end to the first end frame 160 and may extend from the first end frame 160 to pass through the fifth sheave 348 and the first sheave 332 and coupled at the other end to the drill head assembly 180. Similarly, the second sheave 336 and the sixth sheave 352 are operably coupled to one another, via a second cable 368. The second cable 368 may be coupled at one end to the first end frame 160 and may extend from the first end frame 160 to pass through the sixth sheave 352 and the second sheave 336 and coupled at the other end to the drill head assembly 180. The third sheave 340 and the seventh sheave 356 are operably coupled to one another, via a third cable 372. The third cable 372 may be coupled at one end to the second end frame 164 and may extend from the second end frame 164 to pass through the seventh sheave 356 and the third sheave 340 and coupled at the other end to the drill head assembly 180. The fourth sheave 344 and the eighth sheave 360 are operably coupled to one another, via a fourth cable 376. The fourth cable 376 may be coupled at one end to the second end frame 164 and may extend from the second end frame 164 to pass through the eighth sheave 360 and the fourth sheave 344 and coupled at the other end to the drill head assembly 180.

The sheave assembly 144 may be configured to convert the movement of the tube assembly 184 with respect to the rod assembly 188 into the movement (or feed) of the drill head assembly 180 along the mast frame 124. In an example, as shown in FIG. 2, the sheave assembly 144 converts a linear movement (in a direction shown by an arrow 'A') of the tube assembly 184 with respect to the rod assembly 188 towards the first end frame 160 into a downward movement (or feed) of the drill head assembly 180 (and hence, of the drill string assembly 128) along the mast frame 124 relative to the ground 148. In another example, as shown in FIG. 2, the sheave assembly 144 converts a linear movement (in a direction shown by an arrow 'B', opposite to the direction shown by the arrow 'A') of the tube assembly 184 with respect to the rod assembly 188 towards the second end frame 164 into an upward movement of the drill head assembly 180 (and hence, of the drill string assembly 128) along the mast frame 124 relative to the ground 148.

Figure 4:
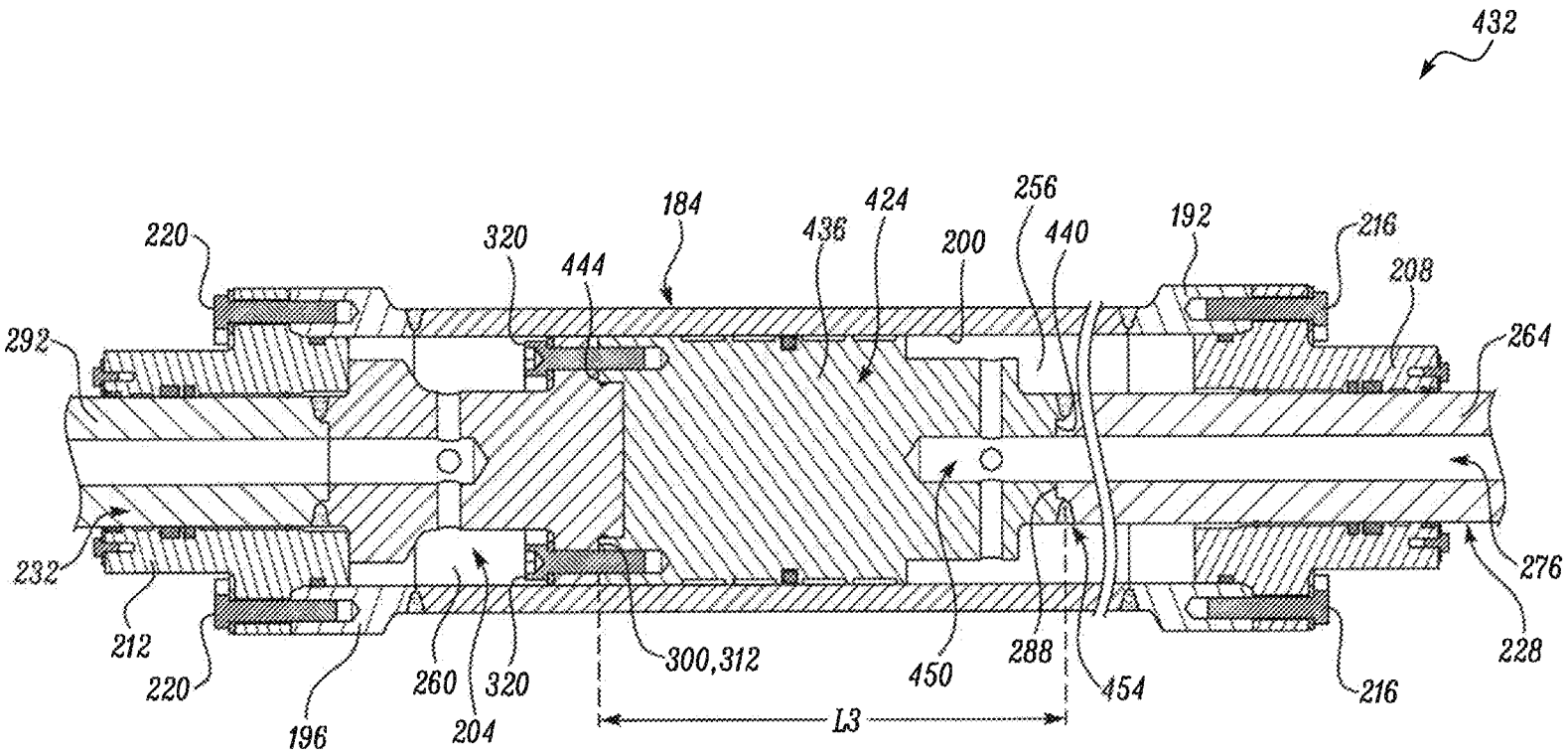
FIG. 4 illustrates a hydraulic actuator, in accordance with another embodiment of the present disclosure.

Referring to FIG. 4, a hydraulic actuator 432 is shown. The hydraulic actuator 432 may be similar in all respects to the hydraulic actuator 132 but may differ from the hydraulic actuator 132 in that the piston 224 and the first stopper 268 (of the first rod 228) are omitted. Rather, the hydraulic actuator 432 includes a piston 424. The piston 424 includes a body 436. The body 436 may define a first end surface 440, a second end surface 444, and a fluid channel 450. The first end surface 440 and the second end surface 444 may be longitudinally offset from each other along a length 'L3' of the body 436. The first end surface 440 may facilitate coupling of the piston 424 with the first rod 228. For instance, as shown in FIG. 4, the first end surface 440 (of the piston 424) is coupled to the end 288 of the first rod 228 using a welded connection 454. The welded connection 454 between the piston 424 and the first rod 228 facilitates in forming a fluid connection between the fluid channel 450 (of the piston 424) and the first channel 276 of the first rod 228 to allow an influx and an efflux of pressurized fluid into and from the first fluid chamber 256. The second end surface 444 may facilitate coupling of the piston 424 with the second rod 232. For instance, as shown in FIG. 4, the second end surface 444 (of the piston 424) is abutted and fastened to the mounting surface 300 (e.g., the projection 312) of the second rod 232, by using the bolts 320.

Figure 5:
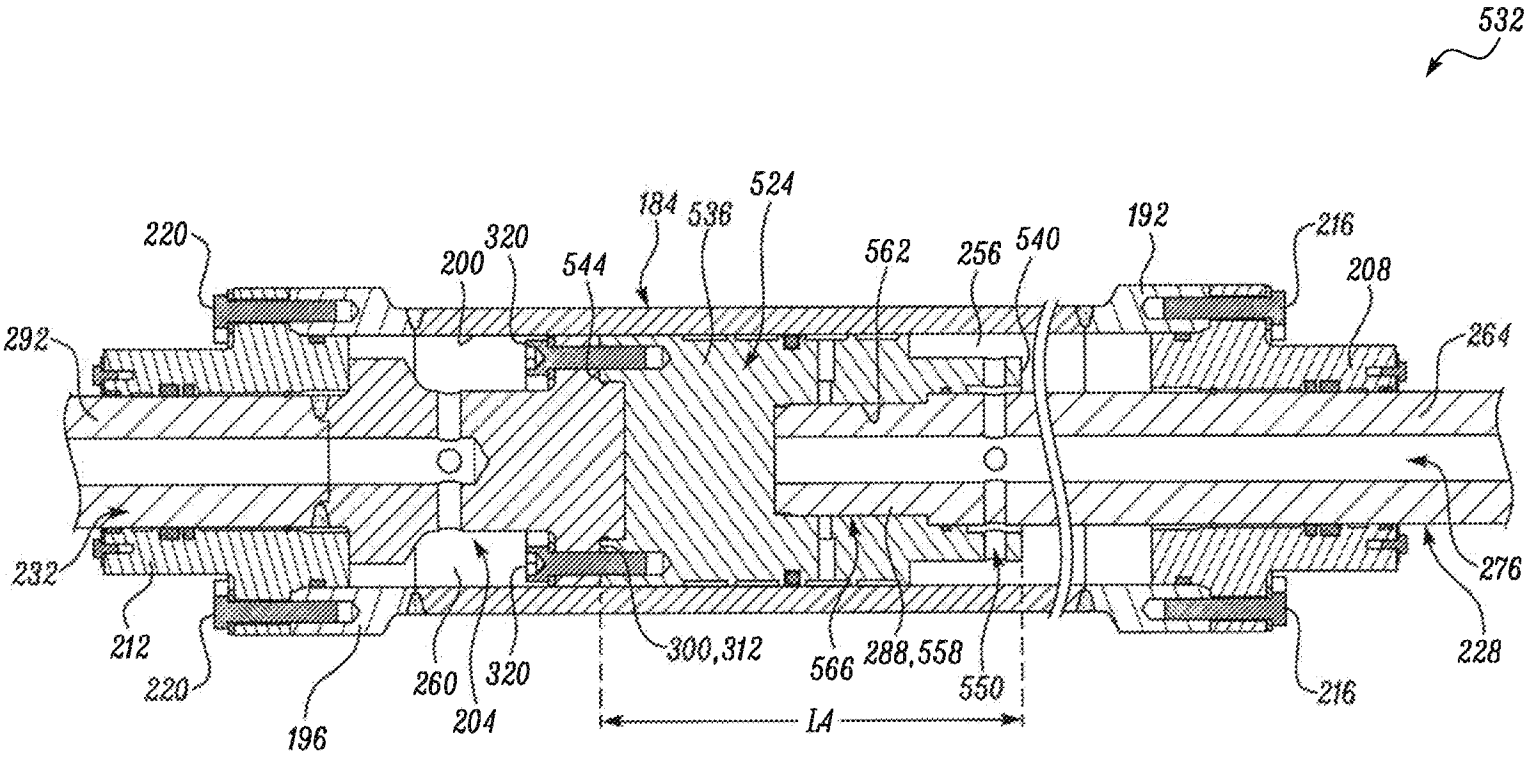
FIG. 5 illustrates a hydraulic actuator, in accordance with yet another embodiment of the present disclosure.

Referring to FIG. 5, a hydraulic actuator 532 is shown. The hydraulic actuator 532 may be similar in all respects to the hydraulic actuator 432 but may differ from the hydraulic actuator 432 in that the piston 424 is omitted. Rather, the hydraulic actuator 532 includes a piston 524, and the end 288 of the first rod 228 defines a threaded portion 558. The piston 524 includes a body 536 defining a first end surface 540, a second end surface 544, a fluid channel 550, and a blind threaded bore 562. The first end surface 540 and the second end surface 544 may be longitudinally offset from each other along a length 'L4' of the body 536. The blind threaded bore 562 may extend inwardly from the first end surface 540 and into the body 536. The blind threaded bore 562 facilitates coupling of the piston 524 with the first rod 228. For instance, as shown in FIG. 5, the blind threaded bore 562 receives and engages with the threaded portion 558 of the first rod 228 to establish a threaded connection 566 therebetween. The threaded connection 566 between the piston 524 and the first rod 228 facilitates in forming a fluid connection between the fluid channel 550 (of the piston 424) and the first channel 276 of the first rod 228 to allow an influx and an efflux of pressurized fluid into and from the first fluid chamber 256. The second end surface 544 may facilitate coupling of the piston 524 with the second rod 232. For instance, as shown in FIG. 5, the second end surface 544 (of the piston 524) is abutted and fastened to the mounting surface 300 (e.g., the projection 312) of the second rod 232, by using the bolts 320.

Figure 6:
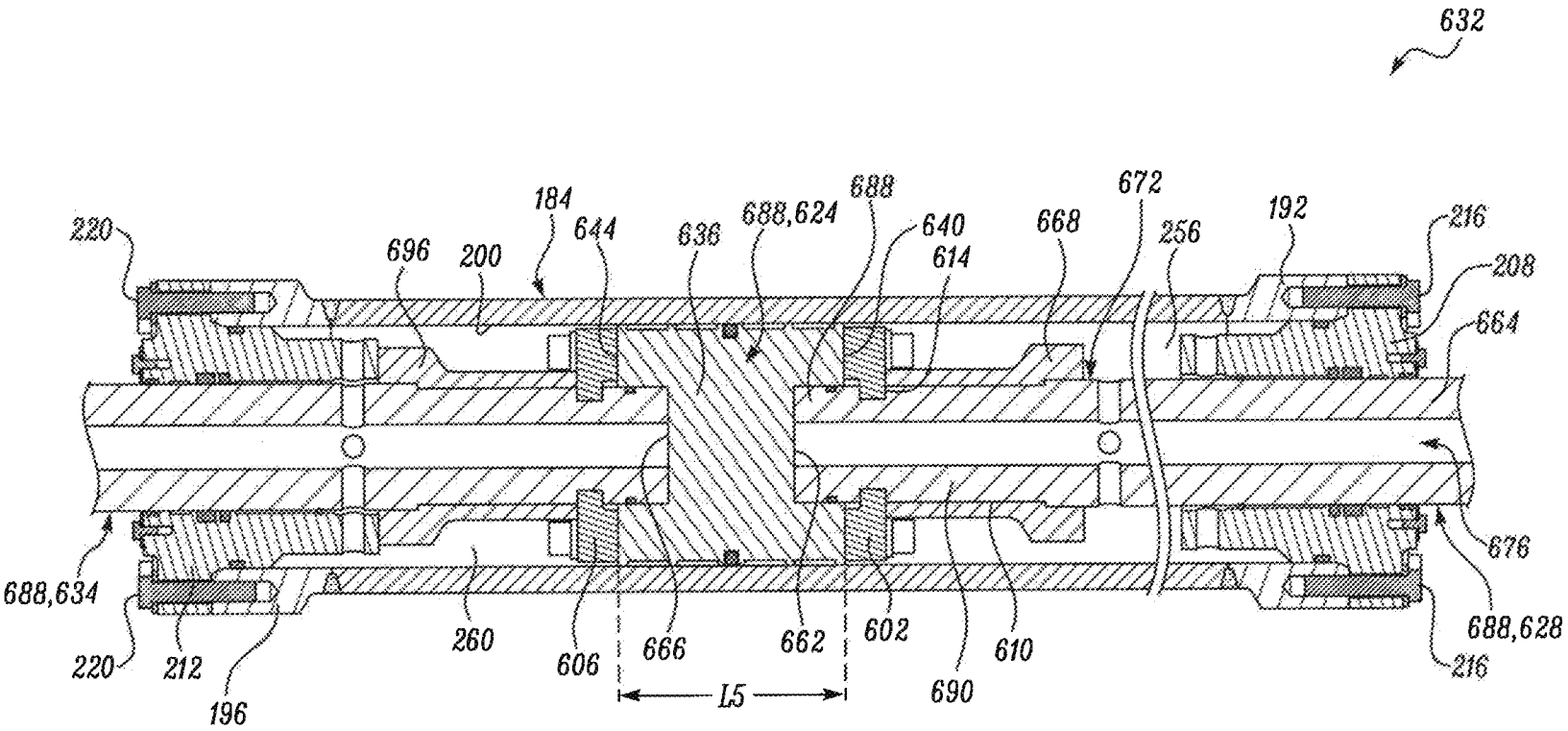
FIG. 6 illustrates a hydraulic actuator, in accordance with still another embodiment of the present disclosure.

Referring to FIG. 6, a hydraulic actuator 632 is shown. The hydraulic actuator 632 may be similar in all respects to the hydraulic actuator 132 but may differ from the hydraulic actuator 132 in that the rod assembly 188 is omitted. Rather, the hydraulic actuator 632 includes a rod assembly 688. The rod assembly 688 includes a piston 624, a first rod 628, a second rod 634, a first split flange 602, a second split flange 606, a first stopper 668, and a second stopper 696. The piston 624 includes a body 636. The body 636 defines a first end surface 640, a second end surface 644, a first blind bore 662, and a second blind bore 666. The first end surface 640 and the second end surface 644 may be longitudinally offset from each other along a length 'L5' of the body 636. The first blind bore 662 may extend inwardly from the first end surface 640 and into the body 636. The first blind bore 662 facilitates coupling of the piston 624 with the first rod 628. The second blind bore 666 may extend inwardly from the second end surface 644 and into the body 636. The second blind bore 666 facilitates coupling of the piston 624 with the second rod 634.

The first rod 628 defines a hollow longitudinal body 664 with an end 690, a first channel 676, and an outer mating surface 672. The first channel 676 is defined within the body 664. The first channel 676 may extend along and throughout a length of the first rod 628. The first channel 676 is configured to be in fluid communication with the first fluid chamber 256 to facilitate an influx and an efflux of a pressurized fluid into and from the first fluid chamber 256. The outer mating surface 672 defines a circumferential step 610 and a circumferential groove 614. The circumferential step 610 is defined at the end 690 of the first rod 628. The circumferential groove 614 is defined at the circumferential step 610.

To assemble the first rod 628 with the piston 624, the first stopper 668 is seated over the circumferential step 610 and the first split flange 602 is seated over the circumferential groove 614. Next, the end 690 of the first rod 628 is received within the first blind bore 662 such that the first split flange 602 abuts against the first end surface 640. Next, the first split flange 602 is fastened to the first end surface 640 of the piston 624, via one or more bolts 618, to fixedly couple the first rod 628 with the piston 624. It should be noted that the second rod 634 may have construction and configuration similar to the first rod 628. Accordingly, it may be contemplated that an assembly of the second rod 634 with the piston 624 is similar to the assembly of the first rod 628 with the piston 624 and hence, is not discussed.

Figure 7:
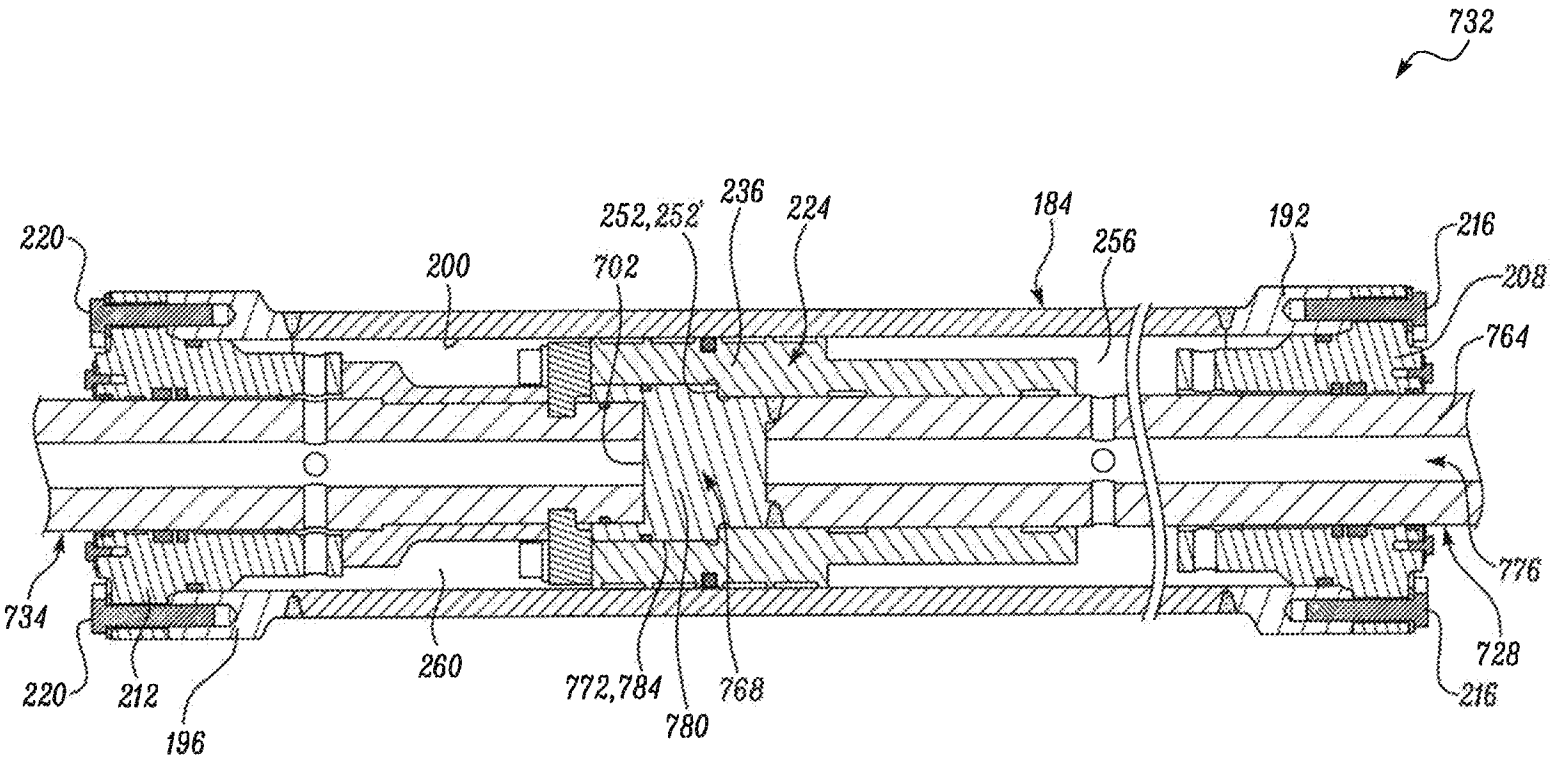
FIG. 7 illustrates a hydraulic actuator, in accordance with still another embodiment of the present disclosure.

Referring to FIG. 7, a hydraulic actuator 732 is shown. The hydraulic actuator 732 may be similar in all respects to the hydraulic actuator 132 but may differ from the hydraulic actuator 132 in that the first rod 228 and the second rod 232 are omitted. Rather, the hydraulic actuator 732 includes a first rod 728 and a second rod 734. The first rod 728 includes a hollow longitudinal body 764, a first stopper 768, and an outer mating surface 772. Also, the first rod 728 defines a first channel 776. The first channel 776 may extend along and throughout a length of the first rod 728. The first channel 776 is configured to be in fluid communication with the first fluid chamber 256 to facilitate an influx and an efflux of a pressurized fluid into and from the first fluid chamber 256. The first stopper 768 may define a stopper body 780, a protrusion 784 extending radially outwardly and away from the stopper body 780, and a depression 702 extending inwardly into the stopper body 780. The first stopper 768 may be coupled (e.g., welded) at one end to the hollow longitudinal body 764 (of the first rod 728) and, may be coupled at the other end to the second rod 734. The outer mating surface 772 may be defined by the protrusion 784. The outer mating surface 772 (e.g., the protrusion 784) of the first rod 728 may be configured to be engaged with (or seated against) the inner engagement surface 252 (e.g., the stepped portion 252) of the piston 224 to lock the first rod 728 with respect to the piston 224. The second rod 734 may have constructions and configurations similar to the second rod 634. Accordingly, it may be contemplated that an assembly of the second rod 734 with the piston 224 is similar to the assembly of the second rod 634 with the piston 624 and hence, is not discussed.

Figure 8:
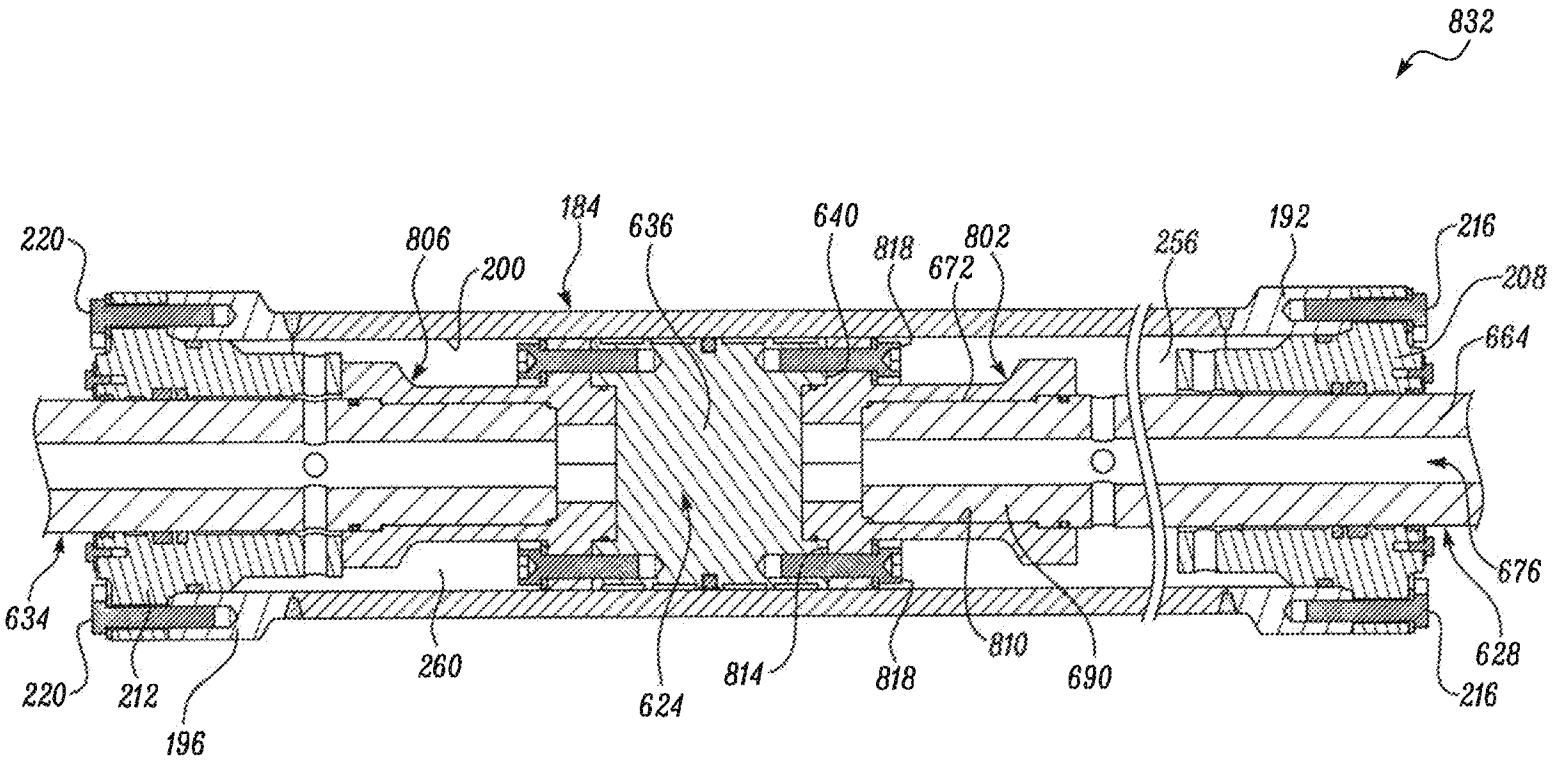
FIG. 8 illustrates a hydraulic actuator, in accordance with still another embodiment of the present disclosure.

Referring to FIG. 8, a hydraulic actuator 832 is shown. The hydraulic actuator 832 may be similar in all respects to the hydraulic actuator 632 but may differ from the hydraulic actuator 632 in that the first split flange 602, the second split flange 606, the first stopper 668, and the second stopper 696 are omitted. Rather, the hydraulic actuator 832 includes a first sleeve 802 and a second sleeve 806. The first sleeve 802 defines a threaded portion 810 and a mounting surface 814. The threaded portion 810 is configured to threadably couple the first sleeve 802 with the outer mating surface 672 of the first rod 628. The mounting surface 814 is configured to abut against and fastened to the first end surface 640 (of the piston 624), by using bolts 818. The second sleeve 806 may have a construction and configuration similar to the first sleeve 802. Accordingly, it may be contemplated that coupling of the second sleeve 806 with the second rod 634 and the piston 624 may be similar to the coupling of the first sleeve 802 with the first rod 628 and the piston 624 and hence, is not discussed.

Figure 9:
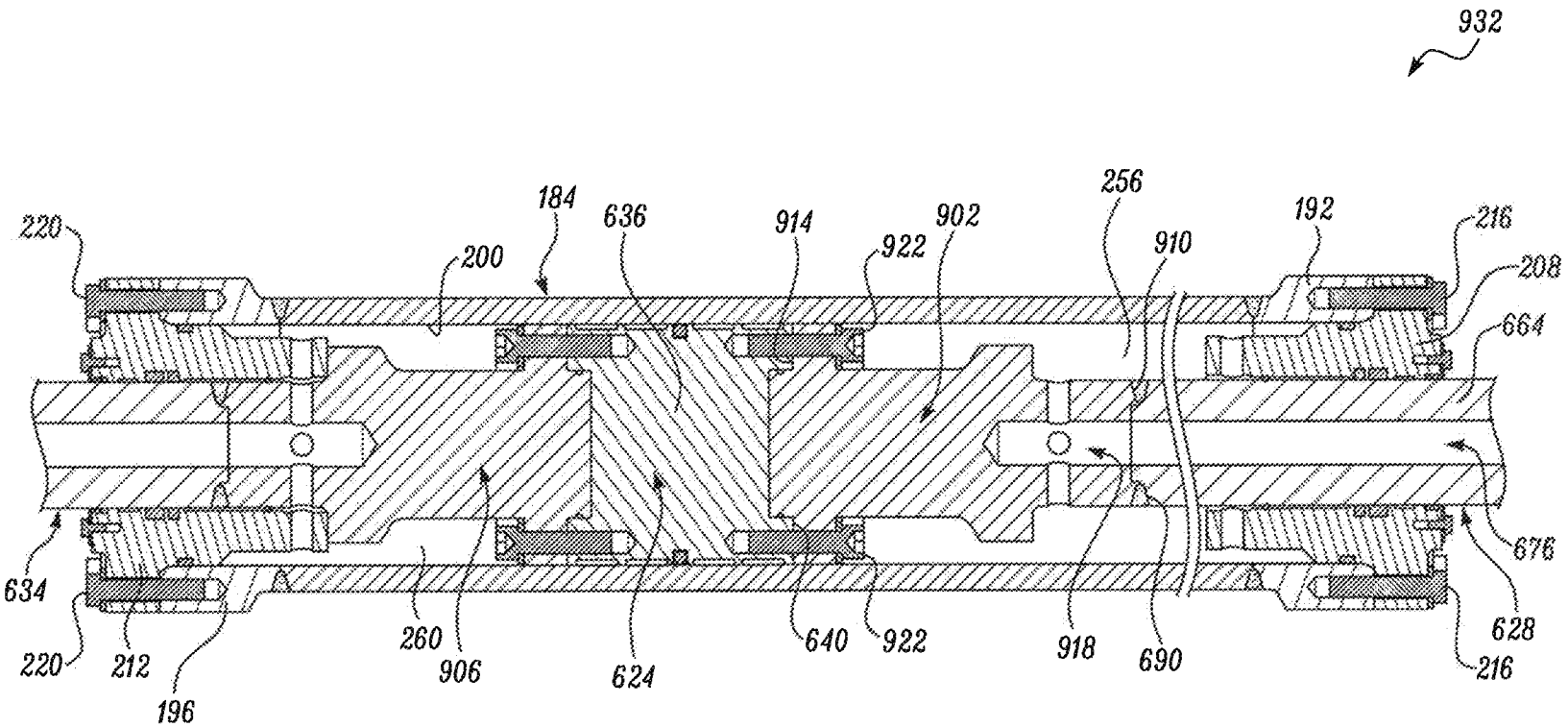
FIG. 9 illustrates a hydraulic actuator, in accordance with still another embodiment of the present disclosure.

Referring to FIG. 9, a hydraulic actuator 932 is shown. The hydraulic actuator 932 may be similar in all respects to the hydraulic actuator 632 but may differ from the hydraulic actuator 632 in that the first split flange 602, the second split flange 606, the first stopper 668, and the second stopper 696 are omitted. Rather, the hydraulic actuator 932 includes a first connector 902 and a second connector 906. The first connector 902 defines a first surface 910, a second surface 914 opposite to the first surface 910, and a fluid channel 918 extending inwardly from the first surface 910 into the first connector 902. The first surface 910 is configured to be coupled (e.g., welded) to the end 690 of the first rod 628 in a manner such that the fluid channel 918 is aligned with the first channel 676 (of the first rod 628) to allow the influx and the efflux of the pressurized fluid into and from the first fluid chamber 256. The second surface 914 is configured to be coupled to the first end surface 640 of the piston 624, by using one or more bolts 922. The second connector 906 may have a construction and configuration similar to the first connector 902. Accordingly, it may be contemplated that coupling of the second connector 906 with the second rod 634 and the piston 624 may be similar to the coupling of the first connector 902 with the first rod 628 and the piston 624 and hence, is not discussed.

INDUSTRIAL APPLICABILITY

Referring to FIGS. 2 and 3, an exemplary installation of the hydraulic actuator 132 (including the tube assembly 184 and the rod assembly 188) at the mast frame 124 of the drilling machine 100 will be now discussed. It should be noted that the hydraulic assemblies 432, 532, 632, 732, 832, 932, may be installed at the mast frame 124 in a manner similar to the installation of the hydraulic assembly 132 at the mast frame 124.

Initially, the mast frame 124 is moved to the second (or stowed) position, for example, from the first (or raised) position (of FIG. 1). Next, the first rod 228 (coupled with the piston 224) is fixedly coupled to the first end frame 160 of the mast frame 124, using the first retainer 136. In an example, as shown in FIG. 3, a threaded end portion 380 (located opposite to the end 288) of the first rod 228 is passed through a mounting hole (not shown) formed on the first end frame 160 and is received within the first retainer 136 in a manner such that the first channel 276 (of the first rod 228) and the first passageway 324 (of the first retainer 136) are aligned and in fluid communication with one another. Subsequently, the first rod 228 is fastened to the first end frame 160, via the first retainer 136. Once fixedly coupled to the first end frame 160, the first rod 228 extends between the first end frame 160 and the piston 224.

Similarly, the second rod 232 (coupled with the piston 224) is fixedly coupled to the second end frame 164 of the mast frame 124, using the second retainer 140. In an example, as shown in FIG. 3, a threaded end portion 384 (located opposite to the end 316) of the second rod 232 is passed through a mounting hole (not shown) formed on the second end frame 164 and is received within the second retainer 140 in a manner such that the second channel 304 (of the second rod 232) and the second passageway 328 (of the second retainer 140) are aligned and in fluid communication with one another. Subsequently, the second rod 232 is fastened to the second end frame 164, via the second retainer 140. Once fixedly coupled to the second end frame 164, the second rod 232 extends between the second end frame 164 and the piston 224. In this configuration, the rod assembly 188 (i.e., the piston 224, the first rod 228, and the second rod 232) is mounted stationary relative to the mast frame 124. Next, the tube assembly 184 (of the hydraulic actuator 132) is operably coupled to the drill head assembly 180 (of the drill string assembly 128) by using the sheave assembly 144.

In order to pulldown (i.e., lower) the drill head assembly 180 (and the drill string assembly 128) relative to the ground 148 during the drilling operation, the pressurized fluid is directed to flow through the first passageway 324, the first channel 276, and into the first fluid chamber 256. Simultaneously, the pressurized fluid present in the second fluid chamber 260 is discharged from the second fluid chamber 260, via the second channel 304 and the second passageway 328. The influx of the pressurized fluid into the first fluid chamber 256 and the efflux of the pressurized fluid from the second fluid chamber 260 facilitates the tube assembly 184 to move with respect to the rod assembly 188 towards the first end frame 160 (i.e., in the direction 'A'). Such movement (i.e., upward movement) of the tube assembly 184 may result in the pulldown (i.e., lowering) of the drill head assembly 180 (and the drill string assembly 128) relative to the ground 148 along the mast frame 124.

Similarly, in order to hoist-up (i.e., elevate) the drill head assembly 180 (and the drill string assembly 128) relative to the ground 148 during the drilling operation, the pressurized fluid is directed to flow through the second passageway 328, the second channel 304, and into the second fluid chamber 260. Simultaneously, the pressurized fluid present in the first fluid chamber 256 is discharged from the first fluid chamber 256, via the first channel 276 and the first passageway 324. The influx of the pressurized fluid into the second fluid chamber 260 and the efflux of the pressurized fluid from the first fluid chamber 256 facilitates the tube assembly 184 to move with respect to the rod assembly 188 towards the second end frame 164 (in the direction 'B'). Such movement (i.e., downward movement) of the tube assembly 184 may result in hoisting-up (i.e., elevate) the drill head assembly 180 (and the drill string assembly 128) relative to the ground 148 along the mast frame 124.

The hydraulic actuator 132, 432, 532, 632, 732, 832, 932, may be utilized in any drilling machine, such as the drilling machine 100, to control feed of an associated drill head assembly (or drill string assembly) to perform drilling operations. The hydraulic actuator 132, 432, 532, 632, 732, 832, 932, has a polylithic construction, i.e., formed by assembling together multiple simple and relatively small-sized parts, for example, such as the tube assembly 184, the piston 224, the first rod 228, and the second rod 232. The polylithic construction of the hydraulic actuator 132, 432, 532, 632, 732, 832, 932 may facilitate easy handling, transportation, and servicing of the hydraulic actuator 132, 432, 532, 632, 732, 832, 932. In addition, the polylithic construction of the hydraulic actuator 132, 432, 532, 632, 732, 832, 932, may reduce or eliminate a possibility of damaging the hydraulic actuator 132, 432, 532, 632, 732, 832, 932, and/or any related assembly, such as the mast frame 124 during installation and removal of the hydraulic actuator 132, 432, 532, 632, 732, 832, 932 on the mast frame 124.

Unless explicitly excluded, the use of the singular to describe a component, structure, or operation does not exclude the use of plural such components, structures, or operations or their equivalents. The use of the terms "a" and "an" and "the" and "at least one" or the term "one or more," and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B" or one or more of A and B") is to be construed to mean one item selected from the listed items (A or B) or any combination of two or more of the listed items (A and B; A, A and B; A, B and B), unless otherwise indicated herein or clearly contradicted by context. Similarly, as used herein, the word "or" refers to any possible permutation of a set of items. For example, the phrase "A, B, or C" refers to at least one of A, B, C, or any combination thereof, such as any of: A; B; C; A and B; A and C; B and C; A, B, and C; or multiple of any item such as A and A; B, B, and C; A, A, B, C, and C; etc.

It will be apparent to those skilled in the art that various modifications and variations can be made to the hydraulic actuator and/or the drilling machine of the present disclosure without departing from the scope of the disclosure. Other embodiments will be apparent to those skilled in the art from consideration of the specification and practice of the hydraulic actuator and/or the drilling machine disclosed herein. It is intended that the specification and examples be considered as exemplary only, with a true scope of the disclosure being indicated by the following claims and their equivalent.

What is claimed is:

1. A hydraulic actuator for controlling an operation of a drilling machine, the hydraulic actuator comprising:

a rod assembly; and a tube assembly including a tube having opposite ends and end structures at the opposite ends, the tube assembly defining a bore to receive the rod assembly therethrough and being moveable with respect to the rod assembly upon an influx and an efflux of a pressurized fluid with respect to the bore to control a feed of a drill head assembly of the drilling machine, wherein the rod assembly is formed from a plurality of parts separable from one another to facilitate assembly or disassembly of the rod assembly with respect to the tube assembly;

wherein the tube assembly includes a releasable connection between at least one of the opposing ends of the tube and at least one of the end structures;

wherein each of the end structures includes a through opening;

wherein the rod assembly includes:

a piston in the tube;

a first rod coupled to the piston and extending in the through opening of one of the end structures; and a second rod coupled to the piston and extending in the through opening of the other end structure.

2. The hydraulic actuator of claim 1, wherein the piston is arranged within the bore to define a first fluid chamber and a second fluid chamber with the bore;

the first rod extending from a first end frame of a mast frame of the drilling machine and coupled to the piston; and the second rod extending from a second end frame of the mast frame and coupled to the piston, wherein the first end frame and the second end frame are offset from one another along a length of the mast frame.

3. The hydraulic actuator of claim 2, wherein the piston, the first rod, and the second rod are stationary relative to the mast frame.

4. The hydraulic actuator of claim 2, wherein the first rod is coupled to the piston using a welded connection.

5. The hydraulic actuator of claim 2, wherein the first rod is coupled to the piston using a threaded connection.

6. The hydraulic actuator of claim 2, wherein the second rod is coupled to the piston using a bolted connection.

7. The hydraulic actuator of claim 2, wherein the first rod defines a first channel configured to facilitate the influx and the efflux of the pressurized fluid into and from the first fluid chamber, and wherein the second rod defines a second channel configured to facilitate the influx and the efflux of the pressurized fluid into and from the second fluid chamber.

8. The hydraulic actuator of claim 1, wherein the rod assembly has a length equal to or greater than 15 meters.

9. A hydraulic actuator for controlling an operation of a drilling machine, the hydraulic actuator comprising:

a rod assembly; and a tube assembly defining a bore to receive the rod assembly therethrough and being moveable with respect to the rod assembly upon an influx and an efflux of a pressurized fluid with respect to the bore to control a feed of a drill head assembly of the drilling machine, wherein the rod assembly is formed from a plurality of parts separable from one another to facilitate assembly or disassembly of the rod assembly with respect to the tube assembly, wherein the rod assembly includes:

a piston arranged within the bore to define a first fluid chamber and a second fluid chamber with the bore;

a first rod extending from a first end frame of a mast frame of the drilling machine and coupled to the piston; and a second rod extending from a second end frame of the mast frame and coupled to the piston, wherein the first end frame and the second end frame are offset from one another along a length of the mast frame, wherein the piston includes a through-bore configured to slidably receive the first rod therein to couple the first rod with the piston, the through-bore defining an inner engagement surface, and wherein the first rod defines an outer mating surface configured to be engaged with the inner engagement surface to lock the first rod with respect to the piston.

10. A drilling machine, comprising:

a mast frame;

a drill string assembly configured to perform an operation of the drilling machine, the drill string assembly including a drill head assembly and one or more pipe segments coupled to the drill head assembly; and a hydraulic actuator for controlling the operation, the hydraulic actuator including:

a rod assembly; and a tube assembly including a tube having opposite ends and end structures at the opposite ends, the tube assembly defining a bore to receive the rod assembly therethrough and being moveable with respect to the rod assembly upon an influx and an efflux of a pressurized fluid with respect to the bore to control a feed of a drill head assembly of the drilling machine, wherein the rod assembly is formed from a plurality of parts separable from one another to facilitate assembly or disassembly of the rod assembly with respect to the tube assembly;

wherein the tube assembly includes a releasable connection between at least one of the opposing ends of the tube and at least one of the end structures;

wherein each of the end structures includes a through opening;

wherein the rod assembly includes:

a piston in the tube;

a first rod coupled to the piston and extending in the through opening of one of the end structures; and a second rod coupled to the piston and extending in the through opening of the other end structure.

11. The drilling machine of claim 10, wherein the piston is arranged within the bore to define a first fluid chamber and a second fluid chamber with the bore;

the first rod extending from a first end frame of the mast frame and coupled to the piston; and the second rod extending from a second end frame of the mast frame and coupled to the piston, wherein the first end frame and the second end frame are offset from one another along a length of the mast frame.

12. The drilling machine of claim 11, wherein the piston, the first rod, and the second rod are stationary relative to the mast frame.

13. The drilling machine of claim 11, wherein the piston includes a through-bore configured to slidably receive the first rod therein to couple the first rod with the piston, the through-bore defining an inner engagement surface, and wherein the first rod defines an outer mating surface configured to be engaged with the inner engagement surface to lock the first rod with respect to the piston.

14. The drilling machine of claim 11, wherein the first rod is coupled to the piston using a welded connection.

15. The drilling machine of claim 11, wherein the first rod is coupled to the piston using a threaded connection.

16. The drilling machine of claim 11, wherein the second rod is coupled to the piston using a bolted connection.

17. The drilling machine of claim 11, wherein the first rod defines a first channel configured to facilitate the influx and the efflux of the pressurized fluid into and from the first fluid chamber, and wherein the second rod defines a second channel configured to facilitate the influx and the efflux of the pressurized fluid into and from the second fluid chamber.

18. The drilling machine of claim 17 further including:

a first retainer configured to fixedly couple the first rod to the first end frame, the first retainer defining a first passageway configured to be in fluid communication with the first channel and the first fluid chamber to facilitate the influx and the efflux of the pressurized fluid into and from the first fluid chamber; and a second retainer configured to fixedly couple the second rod to the second end frame, the second retainer defining a second passageway configured to be in fluid communication with the second channel and the second fluid chamber to facilitate the influx and the efflux of the pressurized fluid into and from the second fluid chamber.

19. The drilling machine of claim 10 further including a sheave assembly coupled between the tube assembly and the drill head assembly, the sheave assembly being configured to convert movement of the tube assembly with respect to the rod assembly into the feed of the drill head assembly along the mast frame.

20. The drilling machine of claim 10, wherein the rod assembly has a length equal to or greater than 15 meters.

* * * * *